US012782012B2

(12) United States Patent
Kondo et al.

(10) Patent No.: US 12,782,012 B2
(45) Date of Patent: Nov. 3, 2026

(54) HEAT PUMP APPARATUS

(71) Applicant: FUJITSU GENERAL LIMITED, Kanagawa (JP)

(72) Inventors: Masahiro Kondo, Kanagawa (JP); Daiki Shimano, Kanagawa (JP); Kazuki Suda, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 119 days.

(21) Appl. No.: 18/847,691

(22) PCT Filed: Mar. 24, 2023

(86) PCT No.: PCT/JP2023/011979
§ 371 (c)(1),
(2) Date: Sep. 17, 2024

(87) PCT Pub. No.: WO2023/190233
PCT Pub. Date: Oct. 5, 2023

(65) Prior Publication Data

US 2025/0198675 A1 Jun. 19, 2025

(30) Foreign Application Priority Data

Mar. 30, 2022 (JP) ..... 2022-055647

(51) Int. Cl.
*F25B 41/26* (2021.01)
*F25B 30/02* (2006.01)

(52) U.S. Cl.
CPC ..... *F25B 41/26* (2021.01); *F25B 30/02* (2013.01)

(58) Field of Classification Search
CPC .. F25B 7/00; F25B 41/26; F25B 30/02; F25B 47/022; F25B 47/025; F25B 49/02; F25B 13/00; F25B 25/005
See application file for complete search history.

(56) References Cited

U.S. PATENT DOCUMENTS 11,137,185 B2 * 10/2021 Farrar ..... F25B 40/06
12,410,956 B2 * 9/2025 Iyoshi ..... F25B 47/025
(Continued)

FOREIGN PATENT DOCUMENTS

EP 2623898 A1 8/2013
JP 2011-127878 A 6/2011
(Continued)

OTHER PUBLICATIONS

JP2011127878A machine translation (Year: 2011).*

*Primary Examiner* — Marc E Norman
(74) *Attorney, Agent, or Firm* — Paratus Law Group, PLLC

(57) ABSTRACT

A heat pump apparatus has a lower stage circuit, a higher stage circuit, a water circuit, a user terminal, and a control device. In a case where the control device determines that frost has been formed at a heat source heat exchanger and switches a first four-way valve to start first defrosting operation, and defrosting is not achieved; the control device controls a refrigerant circuit to switch a second four-way valve and start second defrosting operation. In a case where the first defrosting operation is started, the control device controls a circulation pump and a flow regulating valve to operate the circulation pump in a state where the flow regulating valve is open so that the warm water flows into a user heat exchanger.

8 Claims, 3 Drawing Sheets

(56) References Cited

U.S. PATENT DOCUMENTS

| | | | | |
|---|---|---|---|---|
| 2020/0363086 | A1 | 11/2020 | Matsuda et al. | |
| 2022/0412609 | A1 * | 12/2022 | Pan | F25B 9/008 |

FOREIGN PATENT DOCUMENTS

| | | | |
|---|---|---|---|
| JP | 2012-088005 | A | 5/2012 |
| JP | 2014-109405 | A | 6/2014 |
| WO | WO 2012/043297 | A1 | 4/2012 |
| WO | WO 2013/151005 | A1 | 10/2013 |
| WO | WO 2019/193649 | A1 | 10/2019 |

* cited by examiner

HEAT PUMP APPARATUS

CROSS REFERENCE TO PRIOR APPLICATION

This application is a National Stage Patent Application of PCT International Patent Application No. PCT/JP2023/011979 (filed on Mar. 24, 2023) under 35 U.S.C. § 371, which claims priority to Japanese Patent Application No. 2022-055647 (filed on Mar. 30, 2022), which are all hereby incorporated by reference in their entirety.

FIELD

The present invention relates to heat pump apparatuses.

BACKGROUND

A known heat pump apparatus includes a refrigerant circuit where a refrigerant is circulated by use of a compressor, and a water circuit where water is circulated and warm water is produced by heat exchange with the refrigerant, and the heat pump apparatus supplies the warm water to plural indoor units by use of a circulation pump provided in the water circuit. The heat pump apparatus adjusts temperature in an indoor space where the indoor units have been installed, by generating the warm water through the heat exchange between the water and the refrigerant and circulation of the warm water to the plural indoor units by use of the circulation pump.

Furthermore, a dual cycle may be adopted for the refrigerant circuit, the dual cycle having a lower stage circuit where a first refrigerant circulates, and a higher stage circuit connected to the lower stage circuit, the higher stage circuit being where a second refrigerant that exchanges heat with the first refrigerant circulates. The water circuit is connected to the higher stage circuit and produces the warm water by the heat exchange between the second refrigerant and the water.

A method of performing reverse defrosting as defrosting operation has been proposed for the refrigerant circuit, for which the dual cycle is adopted. In this method, switching is performed between a case where defrosting operation is performed by means of only the lower stage circuit and a case where defrosting operation is performed by means of the lower stage circuit and the higher stage circuit by using both the lower stage circuit and the higher stage circuit, in accordance with a temperature of a heat exchanger in the lower stage circuit at the time of heating operation. As a result, efficient defrosting operation, in which the temperature of the heat exchanger in the lower stage circuit is low, is able to be implemented.

CITATION LIST

Patent Literature

Patent Literature 1: Japanese Laid-open Patent Publication No. 2011-127878

SUMMARY

Technical Problem

However, because warm water to be supplied to heat exchangers in the indoor units is not produced during the defrosting operation, temperature in the indoor space decrease and users' comfort starts to be reduced. Furthermore, in a case where heat in the higher stage circuit is also utilized in defrosting by use of also the higher stage circuit in reverse defrosting operation of the lower stage circuit to obtain the amount of heat needed to melt frost, temperature of a water-refrigerant heat exchanger where the second refrigerant in the higher stage circuit and the water in the water circuit exchange heat may drop below zero degrees Celsius in the conventional heat pump apparatus. As a result, water accumulated in a heat exchanger pipe in the water-refrigerant heat exchanger may freeze and the heat exchanger pipe may be damaged. To prevent this freezing in the heat exchanger pipe, one may thus consider continuing operation of a water pump during the defrosting operation. However, in a case where the operation of the water pump is continued, warm water low in temperature will flow into the heat exchangers in the indoor units, the temperature in the indoor space will thus decrease, and the users' comfort will thus be spoilt.

In view of such problems, an object of the present invention is to provide a heat pump apparatus that enables a user to be comfortable even during defrosting operation.

Solution to Problem

According to an aspect of an embodiment, the heat pump apparatus including a lower stage circuit, a higher stage circuit, a water circuit, a user terminal and a control device. The lower stage circuit has a first compressor, a first four-way valve, a refrigerant-to-refrigerant heat exchanger, a first pressure reducing means, and a heat source heat exchanger. The lower stage circuit is where a first refrigerant circulates. The higher stage circuit has a second compressor, a second four-way valve, a water-refrigerant heat exchanger, a second pressure reducing means, and the refrigerant-to-refrigerant heat exchanger. The higher stage circuit is where a second refrigerant that exchanges heat with the first refrigerant in the refrigerant-to-refrigerant heat exchanger circulates. The water circuit has a circulation pump and the water-refrigerant heat exchanger and produces warm water by heat exchange with the second refrigerant in the water-refrigerant heat exchanger. The user terminal is connected to the water circuit and has a user heat exchanger and a flow regulating valve. The control device controls the first compressor, the first four-way valve, the first pressure reducing means, the second compressor, the second four-way valve, and the second pressure reducing means. The control device has a controller. The controller controls a refrigerant circuit so as to switch the first four-way valve to start first defrosting operation in a case where the controller determines that frost has been formed at the heat source heat exchanger, and to further switch the second four-way valve to start second defrosting operation in a case where defrosting is not achieved by the first defrosting operation. The controller controls the circulation pump and the flow regulating valve to operate the circulation pump in a state where the flow regulating valve is open so that the warm water flows into the user heat exchanger in a case where the first defrosting operation is started.

Advantageous Effects of Invention

In one aspect, a user is able to be comfortable even during defrosting operation.

DESCRIPTION OF EMBODIMENTS

An embodiment of a heat pump apparatus disclosed by the present application will hereinafter be described in detail on the basis of the drawings. Techniques disclosed herein are not to be limited by the embodiment. Furthermore, the embodiment described hereinafter may be modified as appropriate so long as no contradiction is caused by the modification.

First Embodiment

Configuration of Heat Pump Apparatus

Figure 1:
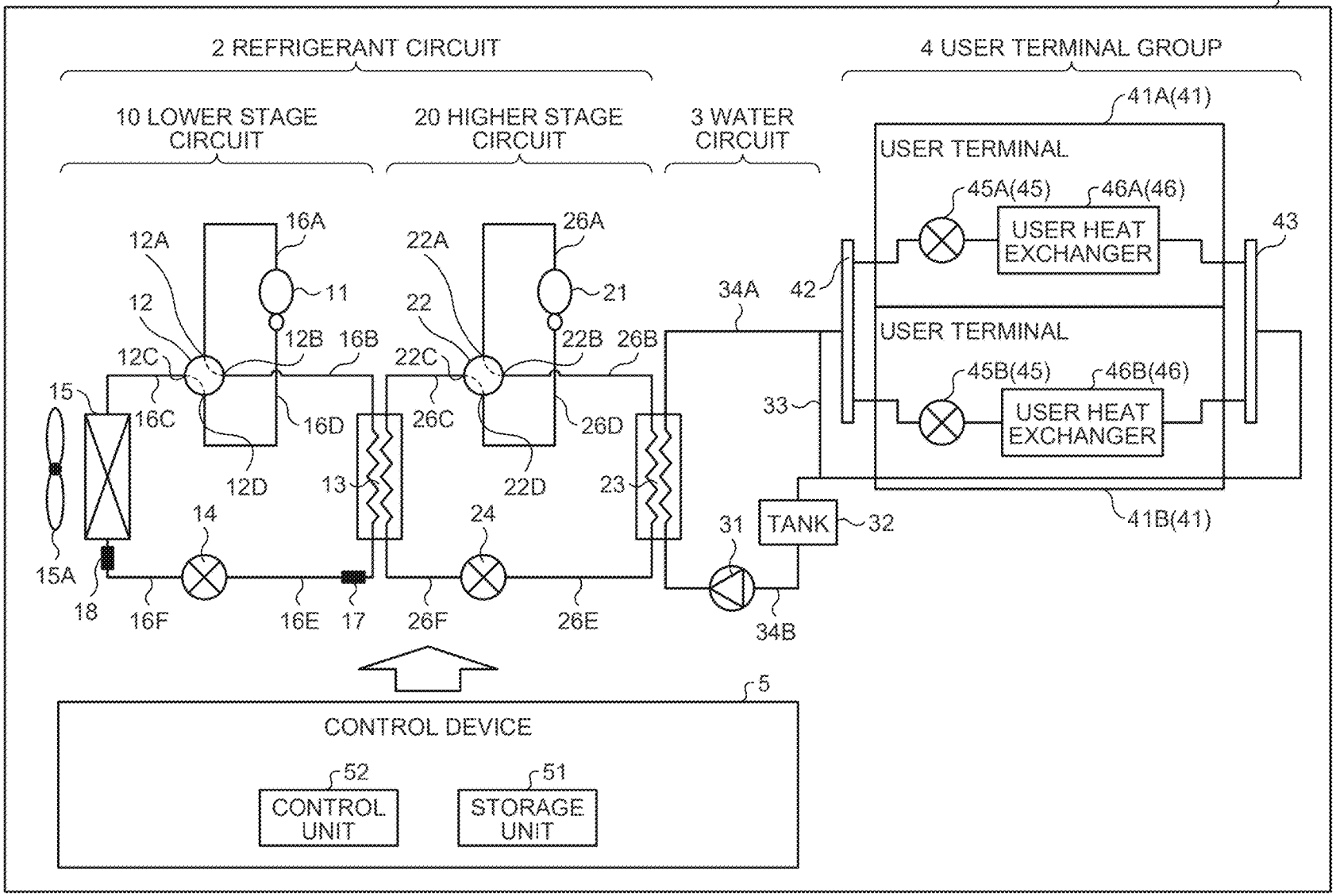
FIG. 1 is a diagram illustrating an example of a heat pump apparatus of an embodiment.

FIG. 1 is a diagram illustrating an example of a heat pump apparatus 1 of an embodiment. The heat pump apparatus 1 illustrated in FIG. 1 has a refrigerant circuit 2, a water circuit 3, a user terminal group 4, and a control device 5. The refrigerant circuit 2 is a circuit where a refrigerant circulates and external air and the refrigerant exchange heat. The water circuit 3 is a circuit where water circulates and the refrigerant from the refrigerant circuit 2 and the water exchange heat. The user terminal group 4 is arranged in an indoor space and is plural user terminals 41, such as a floor heating apparatus, a water heater, and a fan convector, for example. The control device 5 controls the whole heat pump apparatus 1.

Configuration of Refrigerant Circuit

The refrigerant circuit 2 has a lower stage circuit 10 where a first refrigerant circulates, and a higher stage circuit 20 connected to the lower stage circuit 10 and being where a second refrigerant that exchange heat with the first refrigerant circulates. The lower stage circuit 10 has a first compressor 11, a first four-way valve 12, a refrigerant-to-refrigerant heat exchanger 13, a first reducing valve 14 that is a first pressure reducing means, and a heat source heat exchanger 15, and is composed by these components being connected to each other via respective refrigerant pipes 16.

The first compressor 11 is, for example, a high pressure container type variable capacity compressor capable of varying its operation capacity according to driving of a motor having its rotation frequency controlled by an inverter, the motor not being illustrated in the drawings. A refrigerant discharge end of the first compressor 11 is connected to a first port 12A of the first four-way valve 12 via a discharge pipe 16A. Furthermore, a refrigerant intake end of the first compressor 11 is connected to a fourth port 12D of the first four-way valve 12 via an intake pipe 16D.

The first four-way valve 12 is a valve for switching a direction of flow of the first refrigerant in the lower stage circuit 10 and includes the first port 12A, a second port 12B, a third port 12C, and the fourth port 12D. The first port 12A is connected to the refrigerant discharge end of the first compressor 11 via the discharge pipe 16A. The second port 12B is connected to one of refrigerant ports of the refrigerant-to-refrigerant heat exchanger 13 via a refrigerant pipe 16B. The third port 12C is connected to one of refrigerant ports of the heat source heat exchanger 15 via a refrigerant pipe 16C. The fourth port 12D is connected to the refrigerant intake end of the first compressor 11 via the intake pipe 16D.

The refrigerant-to-refrigerant heat exchanger 13 is a cascade heat exchanger where the first refrigerant circulating through the lower stage circuit 10 and the second refrigerant circulating through the higher stage circuit 20 exchange heat. The refrigerant-to-refrigerant heat exchanger 13 functions as a condenser that condenses the first refrigerant passing therethrough during warm water heating operation for producing warm water. The one of the refrigerant ports of the refrigerant-to-refrigerant heat exchanger 13 is connected to the second port 12B of the first four-way valve 12 via the refrigerant pipe 16B. The other one of the refrigerant ports of the refrigerant-to-refrigerant heat exchanger 13 is connected to the first reducing valve 14 via a refrigerant pipe 16E.

The first reducing valve 14 is an electronic expansion valve provided in the refrigerant pipe 16E and is driven by a pulse motor not illustrated in the drawings. Adjustment of the degree of opening of the first reducing valve 14 according to the number of pulses provided to the pulse motor adjusts the amount of the first refrigerant that flows into the heat source heat exchanger 15 in the warm water heating operation.

The heat source heat exchanger 15 is an air heat exchanger that causes heat exchange between external air taken into the heat source heat exchanger 15 by rotation of a fan 15A and the first refrigerant that passes through the heat source heat exchanger 15. The heat source heat exchanger 15 functions as an evaporator that evaporates the first refrigerant that passes through the heat source heat exchanger 15 during the warm water heating operation. The one of the refrigerant ports of the heat source heat exchanger 15 is connected to the third port 120 of the first four-way valve 12 via the refrigerant pipe 16C. The other one of the refrigerant ports of the heat source heat exchanger 15 is connected to the first reducing valve 14 via a refrigerant pipe 16F.

Furthermore, the lower stage circuit 10 has a condenser temperature sensor 17 that is provided between the refrigerant-to-refrigerant heat exchanger 13 and the first reducing valve 14 and detects a refrigerant temperature of the first refrigerant at the condenser, and an evaporator temperature sensor 18 that is provided between the heat source heat exchanger 15 and the first reducing valve 14 and detects a refrigerant temperature of the first refrigerant at the evaporator.

The higher stage circuit 20 has a second compressor 21, a second four-way valve 22, a water-refrigerant heat exchanger 23, a second reducing valve 24 that is a second pressure reducing means, and the refrigerant-to-refrigerant heat exchanger 13, and is composed by these components being connected to each other via respective refrigerant pipes 26.

The second compressor 21 is, for example, a high pressure container type variable capacity compressor capable of varying its operation capacity according to driving of a motor having its rotation frequency controlled by an inverter, the motor not being illustrated in the drawings. A refrigerant discharge end of the second compressor 21 is connected to a first port 22A of the second four-way valve 22 via a discharge pipe 26A. Furthermore, a refrigerant intake end of the second compressor 21 is connected to a fourth port 22D of the second four-way valve 22 via an intake pipe 26D.

The second four-way valve 22 is a valve for switching a direction of flow of the second refrigerant in the higher stage circuit 20 and includes the first port 22A, a second port 22B, a third port 22C, and the fourth port 22D. The first port 22A is connected to the refrigerant discharge end of the second compressor 21 via the discharge pipe 26A. The second port 22B is connected to one of refrigerant ports of the water-refrigerant heat exchanger 23 via a refrigerant pipe 26B. The third port 22C is connected to one of refrigerant ports of the refrigerant-to-refrigerant heat exchanger 13 via a refrigerant pipe 26C. The fourth port 22D is connected to the refrigerant intake end of the second compressor 21 via the intake pipe 26D.

The refrigerant-to-refrigerant heat exchanger 13 functions as an evaporator that evaporates the second refrigerant passing through the refrigerant-to-refrigerant heat exchanger 13 during the warm water heating operation. The one of the refrigerant ports of the refrigerant-to-refrigerant heat exchanger 13 is connected to the second port 22B of the second four-way valve 22 via the refrigerant pipe 26B. The other one of the refrigerant ports of the refrigerant-to-refrigerant heat exchanger 13 is connected to the second reducing valve 24 via a refrigerant pipe 26F.

The second reducing valve 24 is an electronic expansion valve provided in the refrigerant pipe 26F and is driven by a pulse motor not illustrated in the drawings. Adjustment of the degree of opening of the second reducing valve 24 according to the number of pulses provided to the pulse motor adjusts the amount of the second refrigerant that flows into the refrigerant-to-refrigerant heat exchanger 13 in the warm water heating operation.

The water-refrigerant heat exchanger 23 is a heat exchanger where the second refrigerant passing through the water-refrigerant heat exchanger 23 and the water circulating through the water circuit 3 exchange heat. The water-refrigerant heat exchanger 23 functions as a condenser that condenses the second refrigerant passing therethrough during the warm water heating operation. The one of the refrigerant ports of the water-refrigerant heat exchanger 23 is connected to the third port 22C of the second four-way valve 22 via the refrigerant pipe 26C. The other one of the refrigerant ports of the water-refrigerant heat exchanger 23 is connected to the second reducing valve 24 via a refrigerant pipe 26E.

Configuration of Water Circuit

The water circuit 3 produces warm water by heat exchange between the second refrigerant circulating through the higher stage circuit 20 and the water circulating through the water circuit 3. The water circuit 3 has the water-refrigerant heat exchanger 23, a circulation pump 31, a tank 32, and a bypass pipe 33, and is composed by these components being connected to each other via respective pipes 34. The water circuit 3 has an outflow pipe 34A where warm water flows out from the water-refrigerant heat exchanger 23 to the user terminal group 4, and an inflow pipe 34B where warm water flows in from the user terminal group 4 to the water-refrigerant heat exchanger 23.

The circulation pump 31 is, for example, a pump that is capable of varying its operation capacity according to driving of a motor having its rotation frequency controlled by an inverter, the motor not being illustrated in the drawings, and that circulates water through the water circuit 3. The tank 32 is a tank to store the water to be circulated through the water circuit 3. The bypass pipe 33 is a pipe for bypassing the user terminal group 4 in a case where outflow of warm water from the water circuit 3 to the user terminal group 4 is to be blocked.

Configuration of User Terminal Group

The user terminal group 4 has the plural user terminals 41, a splitting pipe 42, and a joining pipe 43. The splitting pipe 42 is a pipe that splits warm water from the water circuit 3 to the respective user terminals 41. The joining pipe 43 is a pipe that joins warm water that has passed through the respective user terminals 41 and returns the warm water that has been joined together to the water circuit 3.

The user terminals 41 each have a user heat exchanger 46 and a flow regulating valve 45. The user heat exchanger 46 is a heat exchanger where the warm water from the water circuit 3 and split from the splitting pipe 42 and air in the indoor space, for example, exchange heat. The flow regulating valve 45 is a valve that adjusts the flow rate of the warm water flowing into the user heat exchanger 46 from the splitting pipe 42.

The user terminals 41 have a direct contact type terminal 41A and a forced convection type terminal 41B. The direct contact type terminal 41A is, for example, a floor heating apparatus that comes into direct contact with a user and adjusts temperature in the indoor space with radiant heat obtained by inflow of the warm water from the water circuit 3 to a radiation panel that is a heat exchanger for heat exchange. The forced convection type terminal 41B is, for example, a fan convector that adjusts the temperature in the indoor space by blowing out, by means of forced convection by a blower fan, for example, air in a heat exchanger where the warm water from the water circuit 3 undergoes heat exchange.

Configuration of Control Device

The control device 5 has a storage unit 51 that stores various types of information and a control unit 52 that controls the whole heat pump apparatus 1. The storage unit 51 stores a terminal type and an operation state, in association with each of pieces of identification information identifying the user terminals 41 in the user terminal group 4. The terminal type is, for example, information identifying a type of the terminal, such as, the direct contact type, the forced convection type, or a natural convection type. The operation state is information indicating whether the user terminal 41 is in operation or inactive. The control unit 52 refers to the terminal types and the operation states that have been stored in the storage unit 51 and that correspond to the identification information on the user terminals 41, and determines whether there is any direct contact type terminal 41A in operation.

The control unit 52 performs control, such that in the warm water heating operation, the first four-way valve 12 is brought into a state where the first port 12A and the second port 12B communicate with each other and the third port 12C and the fourth port 12D communicate with each other, and the second four-way valve 22 is brought into a state where the first port 22A and the second port 22B communicate with each other and the third port 22C and the fourth port 22D communicate with each other. The first refrigerant circulating through the lower stage circuit 10 and the second refrigerant circulating through the higher stage circuit 20 thereby exchange heat in the refrigerant-to-refrigerant heat exchanger 13 and the second refrigerant absorbs heat from the first refrigerant. Furthermore, the control unit 52 controls the circulation pump 31 in the water circuit 3 and the flow regulating valves 45 in the user terminals 41 to operate the circulation pump 31 in a state where the flow regulating valves 45 are open so that warm water flows into the user heat exchangers 46.

The control unit 52 starts first defrosting operation by switching the first four-way valve 12 in a case where the control unit 52 determines that frost has been formed at the heat source heat exchanger 15. Thereafter, in a case where defrosting is not achieved by the first defrosting operation, the second four-way valve 22 is switched to start second defrosting operation. The first four-way valve 12 at the start of the first defrosting operation is switched so that the first port 12A and the third port 12C communicate with each other and the second port 12B and the fourth port 12D communicate with each other. Furthermore, the second four-way valve 22 at the start of the second defrosting operation is switched so that the first port 22A and the third port 22C communicate with each other and the second port 22B and the fourth port 22D communicate with each other. Furthermore, in a case where the control unit 52 starts the first defrosting operation, the control unit 52 controls the circulation pump 31 and the flow regulating valves 45 of the user terminals 41 to operate the circulation pump 31 in a state where the flow regulating valve 45 is open so that warm water flows into the user heat exchanger 46, in order to continue the warm water heating operation by use of heat accumulated in the water circuit 3.

In a case where the direct contact type terminal 41A is present in the user terminals 41 in operation when the first defrosting operation is started, the control unit 52 controls the circulation pump 31 and the flow regulating valves 45 of the user terminals 41 to operate the circulation pump 31 in a state where the flow regulating valve 45A is open so that warm water flows into the user heat exchanger 46A of the direct contact type terminal 41A. A user tends to feel coldness without supply of warm water to the direct contact type terminal 41A during defrosting operation. Therefore, reduction of comfort is minimized by continuation of the warm water heating operation through utilization of the heat accumulated in the water circuit 3 even during the first defrosting operation. In a case where the direct contact type terminal 41A is not present in the user terminals 41 in operation (only the forced convection type terminal 41B is in operation, the forced convection type terminal 41B being where it tends to be comparatively difficult for a user to feel coldness even if warm water is temporarily not supplied), the control unit 52 controls the circulation pump 31 and the flow regulating valves 45 of the user terminals 41 to stop operation of the circulation pump 31 in a state where the flow regulating valves 45 have been closed so that the warm water does not flow into the user heat exchangers 46.

The control unit 52 refers to the terminal types and the operation states that have been stored in the storage unit 51 and that correspond to the identification information on the user terminals 41, and determines whether there is any direct contact type terminal 41A in operation. In a case where the direct contact type terminal. 41A is present in the user terminals 41 in operation when the first defrosting operation is started, on the basis of a result of determining whether there is any direct contact type terminal 41A in operation, the control unit 52 controls the circulation pump 31 and the flow regulating valves 45 to operate the circulation pump 31 in a state where the flow regulating valve 45A is open so that the warm water flows into the user heat exchanger 46A of the direct contact type terminal 41A.

Operation of Heat Pump Apparatus

Figure 2:
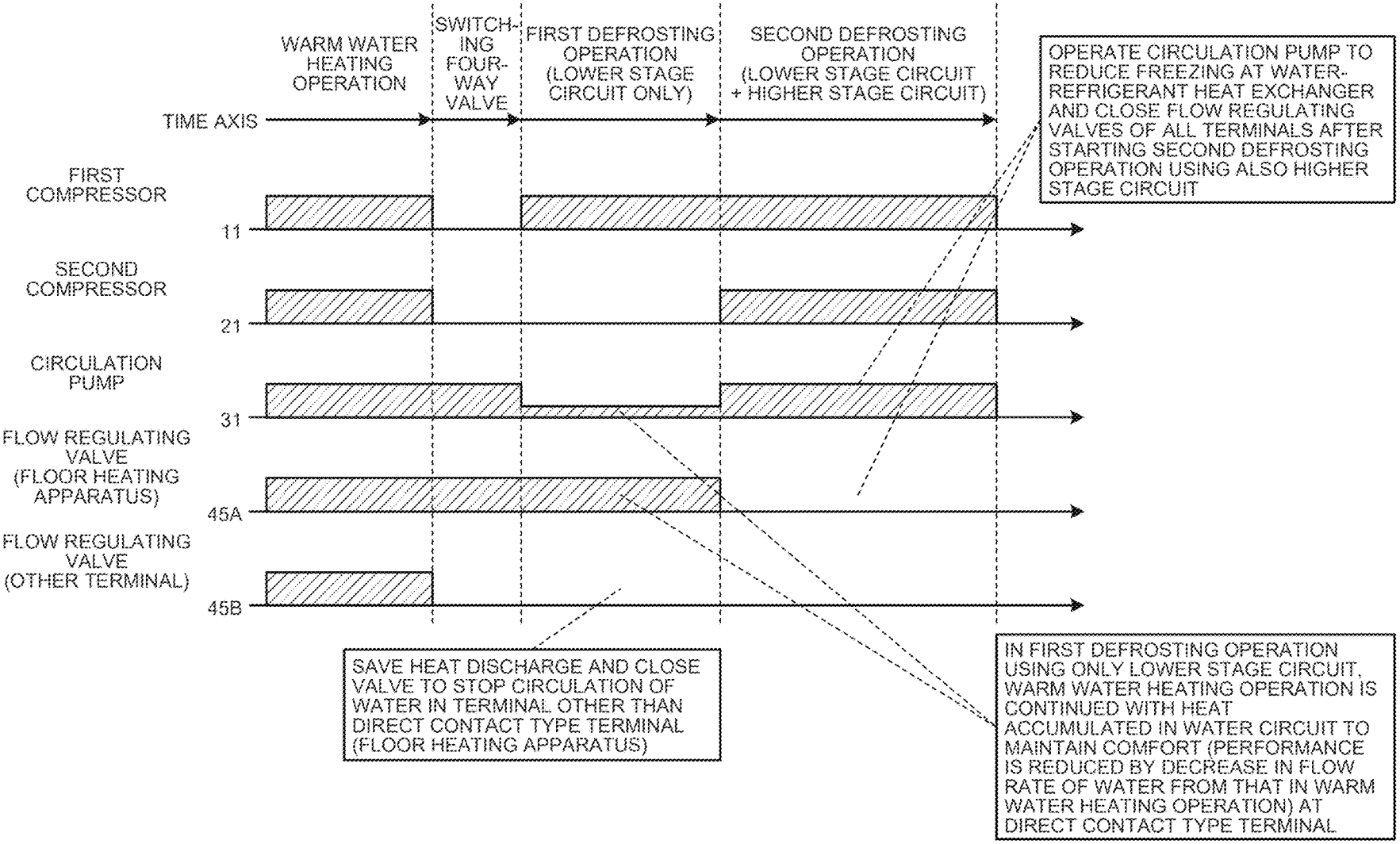
FIG. 2 is a timing chart illustrating operation states of a first compressor, a second compressor, a circulation pump, and flow regulating valves, in first defrosting operation and second defrosting operation.

FIG. 2 is a timing chart illustrating operation states of the first compressor 11, the second compressor 21, the circulation pump 31, and the flow regulating valves 45, during the first defrosting operation and the second defrosting operation. Widths of shaded areas in the figure represent largeness of output to targets to be controlled, the widths being perpendicular to the temporal axis. That is, the larger the width of the shaded area, the larger the rotation frequency of the first compressor 11, the second compressor 21, or the circulation pump 31, and the larger the width of the shaded area, the larger the quantity of control at the flow regulating valve 45A or 45B, that is, the larger the degree of opening of the flow regulating valve 45A or 45B, the widths being perpendicular to the temporal axis. In the warm water heating operation, operation of the first compressor 11 is in an ON state, operation of the second compressor 21 is in an ON state, operation of the circulation pump 31 is in an ON state, the flow regulating valve 45A of the direct contact type terminal 41A is in an open state, and the flow regulating valve 45B of the user terminal 41 other than the direct contact type terminal 41A is in an open state.

At the time of switching the four-way valve upon a switchover from the warm water heating operation to the first defrosting operation, the operation of the first compressor 11 is in an OFF state, the operation of the second compressor 21 is in an OFF state, the operation of the circulation pump 31 is in the ON state, the flow regulating valve 45A of the direct contact type terminal 41A is in the open state, and the flow regulating valve 45B of the user terminal 41 other than the direct contact type terminal 41A is in a closed state. That is, at the time of switching the four-way valve, the direct contact type terminal 41A is able to maintain comfort by continuation of the warm water heating operation with warm water obtained using the heat accumulated in the water circuit 3.

In the first defrosting operation, the operation of the first compressor 11 is in the ON state, the operation of the second compressor 21 is in the OFF state, the operation of the circulation pump 31 is in an ON state (the flow rate of water is made lower than that in the normal ON state), the flow regulating valve 45A of the direct contact type terminal 41A is in the open state, and the flow regulating valve 45B of the user terminal 41 other than the direct contact type terminal 41A is in the closed state. That is, in the first defrosting operation, only the lower stage circuit 10 is operated and the circulation pump 31 is controlled to make the flow rate of water lower than that in the warm water heating operation. Supply of warm water to the user heat exchanger 46B is stopped to reduce the heat discharge to the user terminal 41 other than the direct contact type terminal 41A. As a result, the direct contact type terminal 41A is able to maintain comfort by continuation of the warm water heating operation with the heat accumulated in the water circuit 3. Reducing the flow rate of water in the circulation pump 31 in the first defrosting operation and reducing the heat discharge to the user terminal 41 other than the direct contact type terminal 41A enable the warm water heating operation to be maintained for a long time, the warm water heating operation utilizing the heat accumulated in the water circuit 3.

In the second defrosting operation, the operation of the first compressor 11 is in the ON state, the operation of the second compressor 21 is in the ON state, the operation of the circulation pump 31 is in the ON state, the flow regulating valve 45A of the direct contact type terminal 41A is in a closed state, and the flow regulating valve 45B of the user terminal 41 other than the direct contact type terminal 41A is in the closed state. That is, in the second defrosting operation, the lower stage circuit 10 and the higher stage circuit 20 are operated and the flow rate of water in the circulation pump 31 is returned to the normal flow rate in a state where the flow regulating valves 45 of all the user terminals 41 have been closed. As a result, heat generated from the second compressor 21 in the higher stage circuit 20 and heat accumulated in the water circuit 3 are able to be utilized in defrosting and efficient defrosting of the heat source heat exchanger 15 is thus able to be implemented with the freezing in the water-refrigerant heat exchanger 23 being minimized.

Figure 3:
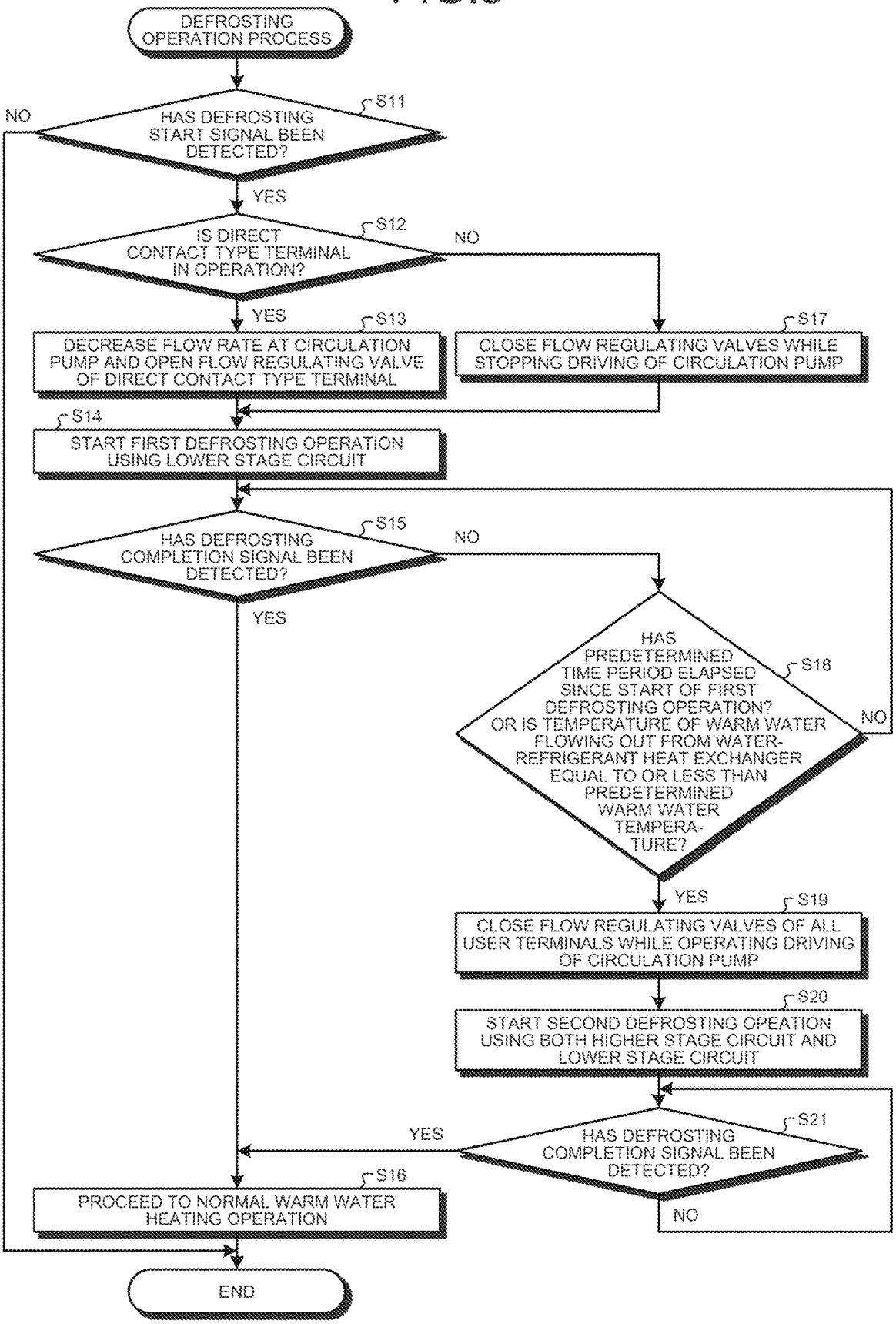
FIG. 3 is a flowchart illustrating an example of processing operation by a control device related to a defrosting operation process.

FIG. 3 is a flowchart illustrating an example of processing operation by the control device 5, the processing operation being related to a defrosting operation process. The control device 5 in FIG. 3 determines whether or not a defrosting start signal indicating a start of defrosting has been detected (Step S11). The defrosting start signal is, for example, a signal output in a case where it is determined that frost has been formed at the heat source heat exchanger 15 where a temperature of the heat source heat exchanger 15 detected by a sensor not illustrated in the drawings becomes a predetermined temperature (for example, −2° C.) or less. In a case where the defrosting start signal has been detected (Step S11: Yes), the control device 5 refers to the types and operation states of the user terminals 41 in the storage unit 51 and determines whether or not the direct contact type terminal 41A is in operation (Step S12).

In a case where the direct contact type terminal 41A is in operation (Step S12: Yes), the control device 5 controls the circulation pump 31 in the water circuit 3 and the flow regulating valve 45 in the direct contact type terminal 41A to decrease the flow rate at the circulation pump 31 and open the flow regulating valve 45 in the direct contact type terminal 41A (Step S13).

The control device 5 starts the first defrosting operation using the lower stage circuit 10, as illustrated in FIG. 2 (Step S14). The control device 5 determines whether or not a defrosting completion signal indicating completion of defrosting has been detected (Step S15). The defrosting completion signal is a signal output in a case where, for example, the temperature at the heat source heat exchanger 15 has exceeded a predetermined temperature (for example, 5° C.).

In a case where the defrosting completion signal has been detected (Step S15: Yes), the control device 5 proceeds to the warm water heating operation (Step S16) and ends the processing operation illustrated in FIG. 3. In a case where the defrosting start signal has not been detected (Step S11: No), the control device 5 ends the processing operation illustrated in FIG. 3.

In a case where the direct contact type terminal 41A is not in operation (Step S12: No), the control device 5 controls the circulation pump 31 in the water circuit 3 and the flow regulating valves 45 in the user terminals 41 to close the flow regulating valves 45 in all of the user terminals 41 while stopping the circulation pump 31 (Step S17). Upon stoppage of the circulation pump 31, the operation of the circulation pump 31 is in the OFF state. After executing the processing of Step S17, the control device 5 returns to the processing of Step S14 to start the first defrosting operation using the lower stage circuit 10.

In a case where the defrosting completion signal has not been detected at Step S15 (Step S15: No), the control device 5 determines whether or not any of conditions has been met, the conditions being a condition where a predetermined time period has elapsed since the start of the first defrosting operation and a condition where the temperature of warm water flowing out from the water-refrigerant heat exchanger 23 is equal to or less than a predetermined warm water temperature (Step S18). The predetermined time period is a time period that enables determination of futile defrosting in a state where the first defrosting operation is being continued and that is preset by, for example, testing. Futile defrosting refers to execution of defrosting operation because of a change in temperature of the heat source heat exchanger 15 to a predetermined temperature or less due to a transient fluctuation even though no frost has been formed at the heat source heat exchanger 15, the change being a condition to start defrosting. When futile defrosting is being performed, the temperature of the heat source heat exchanger 15 rises earlier than when frost has been actually formed, and continuing the first defrosting operation for at least the predetermined time period thus enables prevention of advancement to the second defrosting operation upon futile defrosting. Furthermore, the predetermined warm water temperature is the minimum needed temperature of the warm water to maintain comfort (for example, 40° C.). In a case where the above described condition has been met (Step S18: Yes), the control device 5 controls the circulation pump 31 in the water circuit 3 and the flow regulating valves 45 in the user terminals 41 to close the flow regulating valves 45 in all of the user terminals 41 while operating the circulation pump 31 (Step S19). Upon operation of the circulation pump 31, the operation of the circulation pump 31 is in the ON state.

After executing the processing of Step S19, the control device 5 starts the second defrosting operation using both the lower stage circuit 10 and the higher stage circuit 20 as illustrated in FIG. 2 (Step S20), and determines whether or not the defrosting completion signal has been detected (Step S21). In a case where the defrosting completion signal has been detected (Step S21: Yes), the control device 5 returns to Step S16 to proceed to the warm water heating operation.

Furthermore, in a case where the defrosting completion signal has not been detected (Step S21: No), the control device 5 returns to the processing of Step S21 to determine whether or not the defrosting completion signal has been detected. Furthermore, in a case where the predetermined time period has not elapsed since the start of the first defrosting operation and the temperature of warm water flowing out from the water-refrigerant heat exchanger 23 is higher than the predetermined temperature (Step S18: No), the control device 5 returns to the processing of Step S15 to determine whether or not the defrosting completion signal has been detected.

Effects of Embodiment

In a case where it is determined that frost has been formed at the heat source heat exchanger 15 during the warm water heating operation, the control device 5 of the embodiment switches the first four-way valve 12 to start the first defrosting operation, and in a case where defrosting is not achieved by the first defrosting operation, the control device 5 further switches the second four-way valve 22 to start the second defrosting operation. In a case where the first defrosting operation is started, the control device 5 operates the circulation pump 31 in a state where the flow regulating valve 45 is open so that warm water flows into the user heat exchanger 46. As a result, reduction of comfort is able to be minimized by supply of warm water to the user terminal 41 even during the first defrosting operation.

The control device 5 refers to identification information and operation states that have been stored in the storage unit 51 to determine whether there is any direct contact type terminal 41A in the user terminals 41 that are in operation, and in a case where the direct contact type terminal 41A is present in the user terminals 41 that are in operation when the first defrosting operation is started, the control device 5 operates the circulation pump 31 in a state where the flow regulating valve 45A is open so that warm water flows into the user heat exchanger 46A of the direct contact type terminal 41. In a case where the direct contact type terminal 41A is not present in the user terminals 41 that are in operation, the control device 5 stops the circulation pump 31. As a result, reduction of comfort is able to be minimized even during defrosting operation by supply of warm water to the direct contact type terminal 41A where a user tends to feel coldness.

In a case where the direct contact type terminal 41A is present in the user terminals 41 that are in operation when the first defrosting operation is started, the control device 5 makes the flow rate of warm water to be circulated through the direct contact type terminal 41A less than the flow rate of warm water for the warm water heating operation. As a result, comfort is able to be maintained at the direct contact type terminal 41 while the warm water heating operation is being continued.

In a case where defrosting is not complete even if the predetermined time period has elapsed since the start of the first defrosting operation, the control device 5 starts the second defrosting operation in a controlled state where warm water is circulated to the user terminals 41 in a state where the flow regulating valves 45 of the user terminals 41 have been closed. As a result, as compared to the first defrosting operation using only the lower stage circuit 10, the higher stage circuit 20 and the heat in the water circuit 3 are able to be utilized in defrosting and the time period for defrosting operation is thus able to be shortened. Defrosting is thus able to be completed in a short period of time by having a sufficient amount of heat to melt the frost, and efficient defrosting operation is thus able to be implemented.

In a case where the temperature of warm water that has flown out from the water-refrigerant heat exchanger after the start of the first defrosting operation has become equal to or less than the predetermined temperature, the control device 5 starts the second defrosting operation in the controlled state where warm water is circulated to the user terminals 41 in the state where the flow regulating valves 45 of the user terminals 41 have been closed. As a result, as compared to the first defrosting operation using only the lower stage circuit 10, the higher stage circuit 20 and the heat in the water circuit 3 are able to be utilized in defrosting and the time period for defrosting operation is thus able to be shortened. Defrosting is thus able to be completed in a short period of time by having a sufficient amount of heat to melt the frost, and efficient defrosting operation is thus able to be implemented.

In the case described above as an example, in a case where the direct contact type terminal 41A in operation is present when the first defrosting operation is started, the control device 5 controls the flow regulating valve 45A to make the flow rate of warm water to be circulated through the direct contact type terminal 41A less than the flow rate of warm water for the warm water heating operation. However, this may be modified as appropriate, and the circulation pump 31 may be controlled such that the flow rate of warm water circulated through the direct contact type terminal 41A becomes less than the flow rate of warm water for the warm water heating operation.

Furthermore, each component of each part illustrated in the drawings is not necessarily configured physically as illustrated in the drawings. That is, specific modes of separation and integration of these parts are not limited to those illustrated in the drawings, and all or part thereof may be configured to be functionally or physically separated or integrated in any units according to various loads and use situations, for example.

Furthermore, all or any part of the various processing functions implemented in each apparatus/device may be executed on a central processing unit (CPU) (or a microcomputer, such as a microprocessing unit (MPU) or a microcontroller unit (MCU)). Furthermore, all or any part of the various processing functions may of course be executed on a program analyzed and executed by a CPU (or a microcomputer, such as an MPU or MCU), or on hardware by wired logic.

REFERENCE SIGNS LIST

1 HEAT PUMP APPARATUS
2 REFRIGERANT CIRCUIT
3 WATER CIRCUIT
4 USER TERMINAL GROUP
5 CONTROL DEVICE
10 LOWER STAGE CIRCUIT
11 FIRST COMPRESSOR
12 FIRST FOUR-WAY VALVE
13 REFRIGERANT-TO-REFRIGERANT HEAT EXCHANGER
15 HEAT SOURCE HEAT EXCHANGER
20 HIGHER STAGE CIRCUIT
21 SECOND COMPRESSOR
22 SECOND FOUR-WAY VALVE
23 WATER-REFRIGERANT HEAT EXCHANGER
31 CIRCULATION PUMP
41 USER TERMINAL
45 FLOW REGULATING VALVE
46 USER HEAT EXCHANGER
41A DIRECT CONTACT TYPE TERMINAL
51 STORAGE UNIT
52 CONTROL UNIT

The invention claimed is:

1. A heat pump apparatus, comprising:

a lower stage circuit having a first compressor, a first four-way valve, a refrigerant-to-refrigerant heat exchanger, a first pressure reducing valve, and a heat source heat exchanger, the lower stage circuit being where a first refrigerant circulates;

a higher stage circuit having a second compressor, a second four-way valve, a water-refrigerant heat exchanger, a second pressure reducing valve, and the refrigerant-to-refrigerant heat exchanger, the higher stage circuit being where a second refrigerant that exchanges heat with the first refrigerant in the refrigerant-to-refrigerant heat exchanger circulates;

a water circuit that has a circulation pump and the water-refrigerant heat exchanger and produces warm water by heat exchange with the second refrigerant in the water-refrigerant heat exchanger;

a user terminal that is connected to the water circuit and has a user heat exchanger and a flow regulating valve; and a processor configured to control the first compressor, the first four-way valve, the first pressure reducing valve, the second compressor, the second four-way valve, and the second pressure reducing valve, wherein the processor is configured to controls a refrigerant control the lower stage circuit and the higher stage circuit so as to switch the first four-way valve to start first defrosting operation in a case where the processor determines that frost has been formed at the heat source heat exchanger, and to further switch the second four-way valve to start second defrosting operation in a case where defrosting is not achieved by the first defrosting operation, and control the circulation pump and the flow regulating valve so as to, in a case where a direct contact type terminal is present in a plurality of the user terminals that are in operation when the first defrosting operation is started, operate the circulation pump in a state where the flow regulating valve is open so that the warm water flows into the user heat exchanger of the direct contact type terminal.

2. The heat pump apparatus according to claim 1, comprising:

the plurality of the user terminals, wherein in a case where the direct contact type terminal is not present in the user terminals that are in operation, the processor is configured to control the circulation pump and the flow regulating valves to stop operation of the circulation pump.

3. The heat pump apparatus according to claim 2, further comprising:

a storage configured to store, for each of the user terminals, identification information identifying a type of the user terminal and an operation state of the user terminal, wherein the processor is configured to refer to the identification information and the operation states that have been stored in the storage, determine presence or absence of the direct contact type terminal in the user terminals that are in operation, and control the circulation pump and the flow regulating valves to operate the circulation pump in a state where the flow regulating valve is open so that the warm water flows into the user heat exchanger of the direct contact type terminal in a case where the direct contact type terminal is present in the user terminals that are in operation when the first defrosting operation is started.

4. The heat pump apparatus according to claim 2, wherein in a case where the direct contact type terminal is present in the user terminals that are in operation when the first defrosting operation is started, the processor is configured to control the circulation pump and the flow regulating valve such that a flow rate of the warm water circulated through the direct contact type terminal becomes less than a flow rate of the warm water in warm water heating operation.

5. The heat pump apparatus according to claim 2, wherein in a case where defrosting is not complete even when a predetermined time period has elapsed since the start of the first defrosting operation, the processor is configured to start the second defrosting operation in a state of having controlled the circulation pump and the flow regulating valves so that the warm water circulates through the user terminals in a state where the flow regulating valves of the user terminals have been closed.

6. The heat pump apparatus according to claim 5, wherein in a case where temperature of the warm water that flows out from the water-refrigerant heat exchanger does not become higher than a predetermined warm water temperature before elapse of the predetermined time period since the start of the first defrosting operation, the processor is configured to determine that the defrosting by the first defrosting operation is unable to be completed.

7. The heat pump apparatus according to claim 2, wherein the direct contact type terminal is a floor heating apparatus.

8. The heat pump apparatus according to claim 1, wherein the user terminal or the user terminals include a forced convection type terminal or a natural convection type terminal.

* * * * *